United States Patent [19]

Arnold

[11] Patent Number: 4,947,713

[45] Date of Patent: Aug. 14, 1990

[54] ELASTOMERIC SLEEVE ON REARWARD PORTION OF WRENCH SOCKET TO FACILITATE RECOGNITION AND SELECTION OF THE SOCKET

[75] Inventor: Robert L. Arnold, Lancaster, Pa.

[73] Assignee: Easco Hand Tools, Inc., Hunt Valley, Md.

[21] Appl. No.: 804,533

[22] Filed: Dec. 4, 1985

[51] Int. Cl.[5] ..... B25B 13/06

[52] U.S. Cl. ..... 81/121.1; 81/DIG. 5; 81/177.1; 81/184

[58] Field of Search ..... 81/121.1, 122–123, 81/DIG. 5, 177.1, 177.85, 180.1, 184, 185, 900, 489, 492; 33/166; 16/116 R, DIG. 12

[56] References Cited

U.S. PATENT DOCUMENTS

| | | | |
|---|---|---|---|
| 1,350,185 | 8/1920 | Shaw | 33/166 |
| 1,658,886 | 2/1928 | Dickey | 81/121.1 |
| 2,161,163 | 6/1939 | Hedspeth | 81/DIG. 5 X |
| 2,644,240 | 7/1953 | Stedman | 33/166 |
| 2,871,899 | 2/1959 | Coyle et al. | 81/177.1 |
| 3,189,069 | 6/1965 | Stowell | 81/177.1 |
| 4,004,476 | 1/1977 | De Vrou | 81/177.2 |

OTHER PUBLICATIONS

*Husky Mechanics' Hand Tools,* "Carbon Socket Wrench Sets", Cat. #103, 8/1961, p. 17.

*Jensen Tools and Alloys, "Cushion Grip Screwdrivers", Fall Catalog 1977, p. 86.*

*Primary Examiner*—D. S. Meislin

*Attorney, Agent, or Firm*—Leonard Bloom

[57] ABSTRACT

A molded elastomeric sleeve is carried by the rearward portion of a wrench socket. The sleeve has size indicia molded directly thereon (and may also be color coded) thereby facilitating a quick and convenient identification and selection of the respective socket from a tool box or kit. Suitable knurls on the outer diameter of the sleeve facilitate a manual rotation of the socket for seating a nut or bolt, prior to torquing with a conventional ratchet wrench. The knurls also prevent the socket from rolling, if placed sideways on a flat surface. Preferably, the rearward portion of the socket has a reduced diameter, thereby forming an annular shoulder between the forward and rearward portions of the socket, and the sleeve abuts against the annular shoulder. In an alternate embodiment, the sleeve is keyed to the socket, preferably by a "double dee" configuration, to prevent slippage or relative rotation between the socket and sleeve.

21 Claims, 4 Drawing Sheets

ELASTOMERIC SLEEVE ON REARWARD PORTION OF WRENCH SOCKET TO FACILITATE RECOGNITION AND SELECTION OF THE SOCKET

FIELD OF THE INVENTION

The present invention relates to a wrench socket (or sockets) used with ratchet wrench kits or the like, and more particularly, to a sleeve carried on the rearward portion of a respective socket to quickly facilitate recognition and selection of a desired socket in the kit.

BACKGROUND OF THE INVENTION

Socket kits or sets usually have a ratchet wrench, various adapters, accessories or attachments, and a plurality of sockets used interchangeably with the ratchet wrench. The ratchet wrench comprises a driving handle having a square-drive tang or stud which, for example, may constitute a ¼", ⅜" or ½" drive. The sockets usually have an output hexagonal bore for engagement with a nut or head of a bolt; and these hexagonal sockets may range, for example, from 3/16" to ¾" in sixteenth inch increments.

The average ratchet wrench kit may have about a dozen individual sockets, each of which is stamped with the size of its output hexagonal bore. These size indications are hard to see, especially when used beneath a vehicle, in cramped quarters, or in poorly lighted working areas. The individual pieces in a kit sometimes get mixed up, and the problem may be compounded due to English and Metric sizes.

SUMMARY OF THE INVENTION

Accordingly, it is an object of the present invention to alleviate the disadvantages and deficiencies of the prior art by providing an identifying sleeve on the rearward portion of each socket, thereby quickly facilitating user recognition and selection of a desired socket.

It is another object of the present invention to provide a molded elastomeric sleeve that has size indicia molded thereon, and, if desired, may be color coded.

It is yet another object of the present invention to provide an identifying sleeve for a wrench socket, which may be manufactured easily and economically, and which facilitates a merchandising and promotion of entire wrench kits or sets having sockets equipped with respective identifying sleeves.

In accordance with the teachings of the present invention, a wrench socket has respective forward and rearward portions, and an elastomeric sleeve is secured on the rearward portion of the socket. Indicia means are provided on the sleeve for facilitating convenient recognition of the socket, and the sleeve has an outer diameter provided with knurls for facilitating a mannual rotation of the socket.

In accordance with the further teachings of the present invention, the rearward portion of the socket has a reduced outer diameter thereby forming an annular shoulder between the forward and rearward portions of the socket, and the sleeve abuts against the annular shoulder. Preferably, the forward portion of the socket has an outer diameter which is substantially coterminous, radially, with the outer diameter of the sleeve. Additionally, keying means may be provided between the sleeve and the rearward portion of the socket. Preferably, the keying means includes a pair of substantially diametrically-opposed flats formed on the rearward portion of the socket and cooperating, respectively, with a pair of substantially diametrically-opposed flat portions formed within the sleeve. Moreover, the indicia means includes different colors and size markings, the latter being molded within the sleeve.

In yet another aspect of the present invention, a sleeve is adapted to be secured to the rearward portion of a wrench socket. The sleeve has indicia means thereon for facilitating a convenient recognition and selection of the socket. Preferably, the sleeve and socket have respective rearward end faces which are substantially aligned axially with one another, and the sleeve is provided with knurls for facilitating a manual rotation of the socket.

These and other objects of the present invention will become apparent from a reading of the following specification, taken in conjunction with the enclosed drawings.

GENERAL DESCRIPTION OF THE PREFERRED EMBODIMENT

Figure 1:
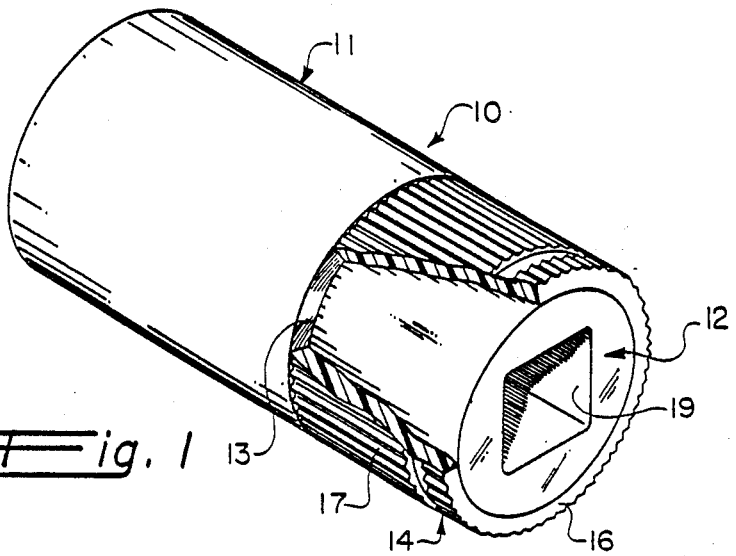
FIG. 1 is a perspective view of a preferred embodiment of a typical wrench socket having an elastomeric identifying sleeve carried on the rearward portion of the socket, in accordance with the teachings of the present invention.
Figure 2:
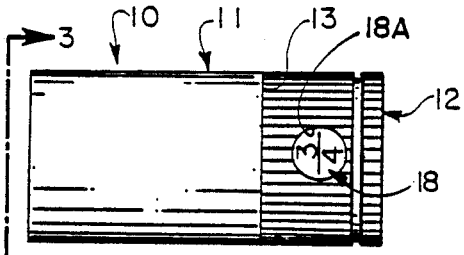
FIG. 2 is a side elevation of the socket and sleeve of FIG. 1.
Figure 3:
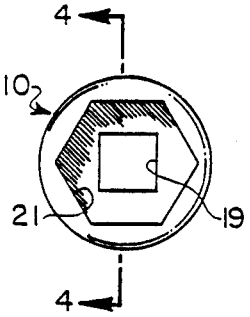
FIG. 3 is an end view thereof, taken along the lines 3—3 of FIG. 2, and looking into the hexagonal bore in the socket.

With reference to FIGS. 1–4, a wrench socket 10 has a forward portion 11 and a rearward portion 12. The rearward portion 12 may be diametrically-reduced (or turned down) to form an annular shoulder 13 between the forward and rearward portions of the socket. A sleeve 14 is carried on the reduced rearward portion of the socket and may abut (or seat) against the annular shoulder. Preferably, the sleeve 14 is integrally molded from a suitable plastic, rubber or other elastomeric material. A suitable adhesive (denoted schematically by 15 in FIG. 4) secures the sleeve on the socket and precludes an axial separation therebetween.

Figure 4:
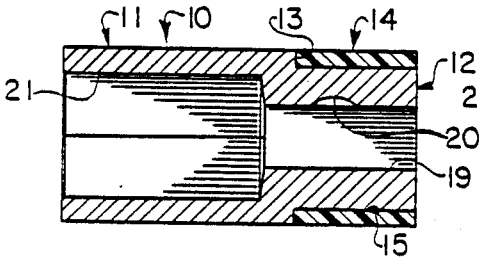
FIG. 4 is a longitudinal section of the socket and sleeve, taken across the lines 4—4 of FIG. 3, and showing the sleeve substantially coterminous, radially, with the outer diameter of the socket (with respect to certain sockets).
Figure 10:
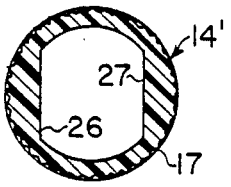
FIG. 10 is a cross-sectional view of the socket, taken along the lines 10—10 of FIG. 9, and showing the "double dee" configuration for keying the socket to the sleeve.
Figure 8:
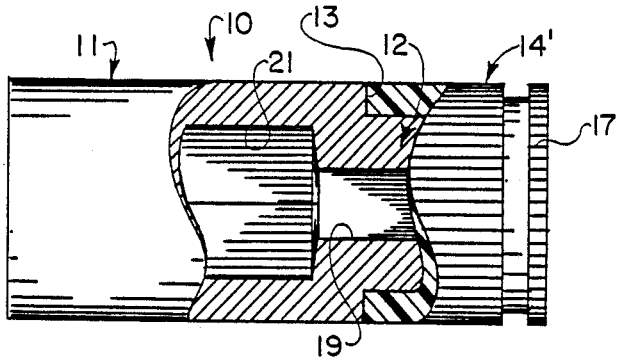
FIG. 8 is a longitudinal section, partially in elevation, of the socket and sleeve of FIG. 7.

The sleeve 14 has an end face 16 which, preferably, is coterminous (axially) with the rearward end of the socket, as shown more clearly in FIGS. 1 and 4. The sleeve further has an outer diameter which is substantially coterminous (radially) with the outer diameter of the forward portion 11 of the socket, as shown more clearly in FIG. 4. The outer diameter of the sleeve is provided with a plurality of longitudinal knurls 17 (or other flutes or splines) to facilitate a manual gripping of the sleeve (as shown in FIG. 10). These knurls also tend to prevent the socket from rolling, if placed sideways on a flat surface. The axial length of the sleeve may range from about ½" to 1" for most sockets.

The sleeve 14 is provided with suitable size indicia (generally indicated as at 18 in FIG. 2) disposed in a suitable recess 18A for easy identification and selection in a tool box or kit. The indicia (numbers and/or letters) are preferably molded within the sleeve and may be raised or projecting; and, if desired, the indicia may be molded clear through, so that the underlying socket portion is visible. The sleeve may also be color coded.

As shown more clearly in FIG. 4, the socket has a square drive input bore 19 provided with spaced pockets 20. These pockets 20 are adapted to receive the conventional ball detent (not shown) carried on the drive tang or stud of the wrench. The socket further has a conventional hexagonal drive output bore 21 for cooperation with the head of a bolt 22 (shown in FIGS. 10 and 11) or the nut 23.

Figure 5:
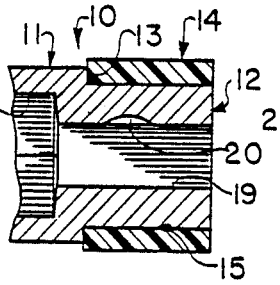
FIG. 5 is a partial longitudinal section, corresponding substantially to a portion of FIG. 4, but showing how the sleeve may extend, radially, somewhat beyond the outer diameter of the socket (with respect to certain other sockets).

With respect to some other sockets in the kit, the sleeve 14 may extend somewhat (radially) beyond the outer diameter of the forward portion of the socket, as shown in FIG. 5, but is still substantially coterminous therewith.

Figure 6:
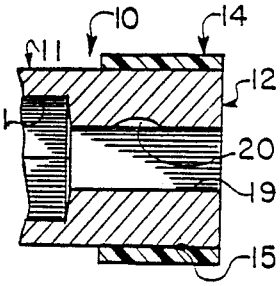
FIG. 6 is a partial longitudinal section, corresponding to a portion of FIG. 4, but showing the sleeve extending radially of the socket, and further showing the sleeve adhesively secured on the rearward portion of the socket without an annular shoulder formed on the socket between the forward and rearward portions thereof.
Figure 7:
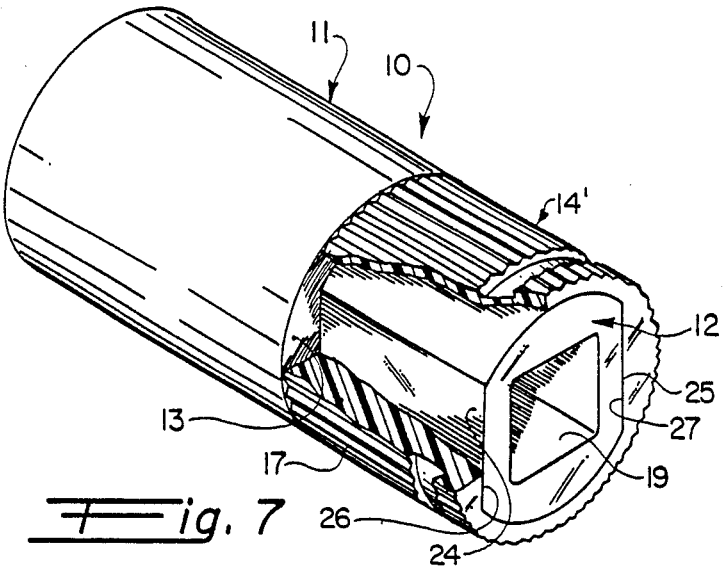
FIG. 7 is a perspective of a second embodiment of a typical wrench socket having an elastomeric sleeve carried on the rearward portion thereof, in accordance with the teachings of the present invention.
Figure 9:
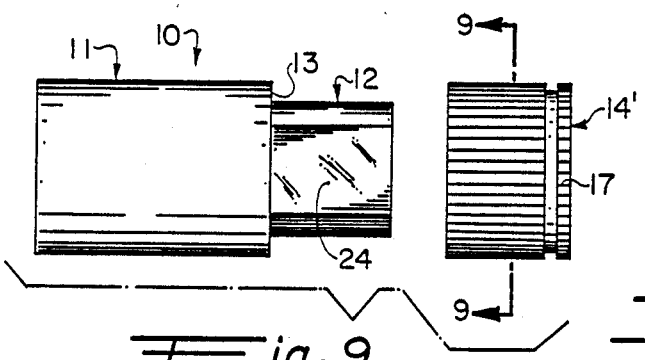
FIG. 9 is an exploded view of the socket and sleeve of FIG. 7.

As shown in FIG. 6, the sleeve 14 is carried on the rearward portion of the socket 10 (being adhesively secured thereto) and there is no annular shoulder between the respective forward and rearward portions of the socket.

With respect to FIGS. 7–10 (wherein like numbers are used for similar parts) an alternate embodiment is illustrated wherein the rearward portion 12 of the socket 10 is provided with a pair of diametrically-opposed flats 24 and 25. These flats cooperate with a pair of corresponding diametrically-opposed flats 26 and 27 formed within the sleeve 14'. The cooperating flats provide a means for keying the sleeve 14' to the socket 10 and further precluding relative rotation therebetween.

Figure 11:
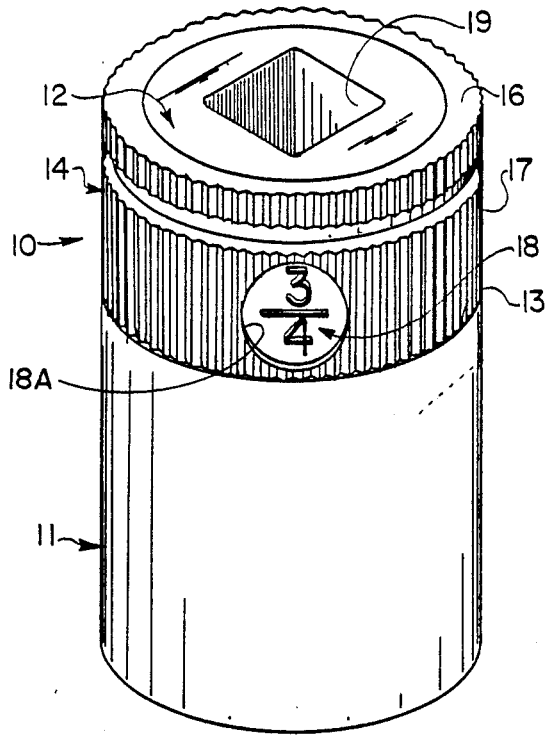
FIG. 11 is a further perspective of the socket and sleeve of FIG. 1, showing the raised molded-in indicia, as the socket is oriented with its hex output socket portion facing down.
Figure 12:
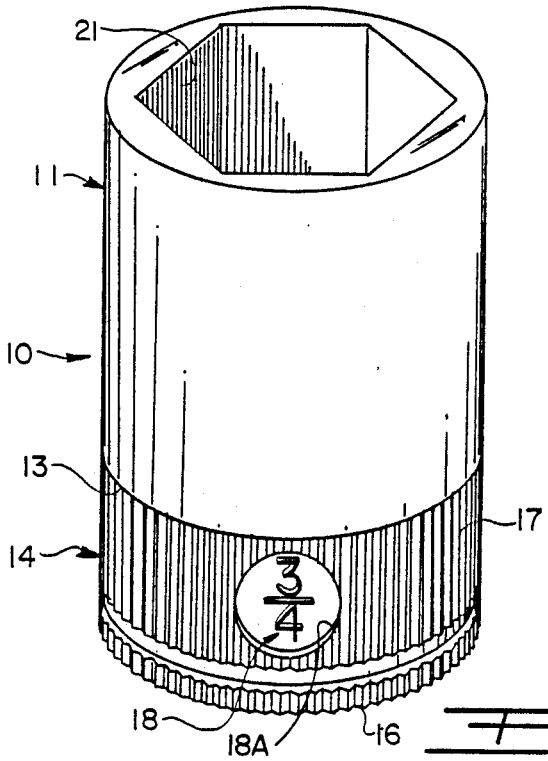
FIG. 12 is a still further perspective, corresponding substantially to FIG. 11, but showing the other side of the socket, and with the hex output socket portion facing up.

As shown in FIG. 11, the socket 10 is facing down, its sleeve is up, and the "¾" molded-in raised indicia 18 disposed in a suitable recess 18A on the sleeve is clearly visible. On the diametrically-opposed other side of the sleeve 14, the indicia 18 (such as the "¾" size marking) is reversed or inverted. With this arrangement, when the hex output portion of the socket is facing up as shown in FIG. 12, the "¾" indicia disposed in the recess 18A on the sleeve will be properly oriented for easy inspection, recognition and selection.

Figure 13:
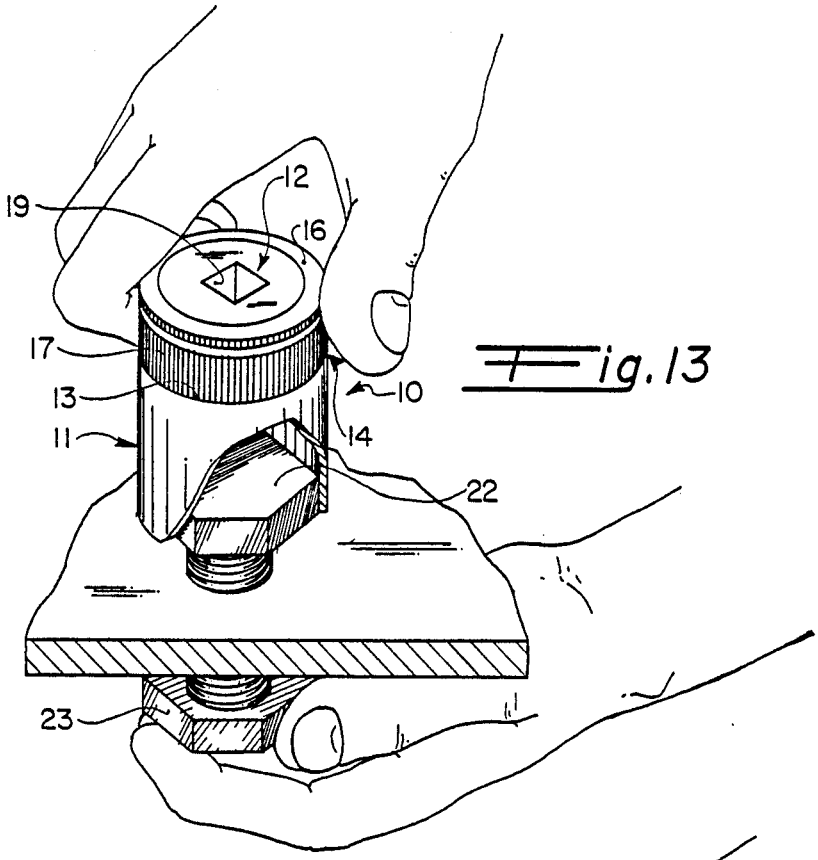
FIG. 13 illustrates how the sleeve may be grasped by the user for conveniently rotating the socket for seating the nut on the bolt in a typical application.
Figure 14:
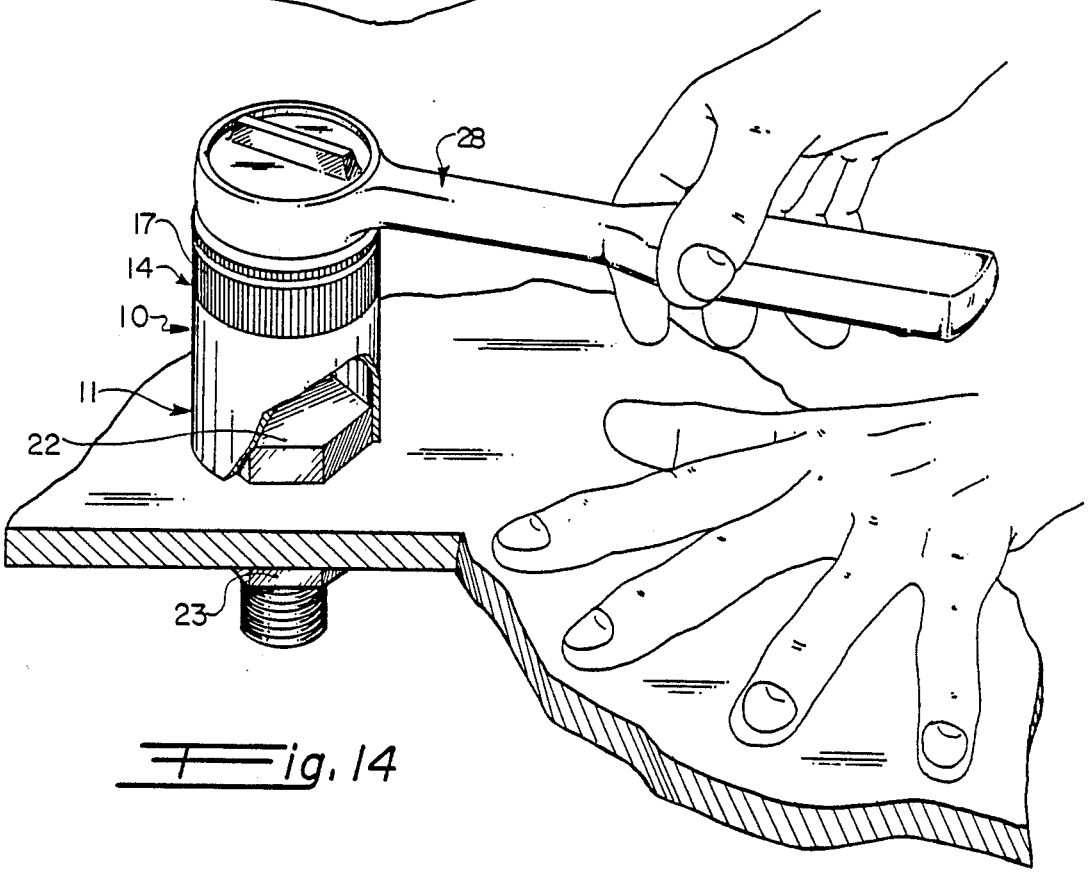
FIG. 14 illustrates the subsequent torquing of the bolt, using a conventional ratchet wrench for driving the socket.

As shown in FIG. 13, the sleeve 14 may be grasped by the user to conveniently rotate the socket 10 for driving the bolt 22 on the nut 23. Thereafter, and when the nut is seated as shown in FIG. 14, the conventional ratchet wrench 28 may be used to torque the bolt.

Obviously, many modifications may be made without departing from the basic spirit of the present invention. For example, in lieu of a sleeve, a cap or bushing may be used. Accordingly, it will be appreciated by those skilled in the art that within the scope of the appended claims, the invention may be practiced other than specifically described herein.

What is claimed is:

1. In combination with a wrench socket having respective forward and rearward portions, an elastomeric sleeve secured on the rearward portion of the socket, the sleeve having an outer diameter provided with knurls for facilitating a manual rotation of the socket, said sleeve further having a recess formed therein, and indicia means disposed in the recess on the sleeve for facilitating convenient recognition of the socket.

2. The combination of claim 1, wherein the rearward portion of the socket has a reduced outer diameter, thereby forming an annular shoulder between the forward and rearward portions of the socket, and wherein the sleeve abuts against the annular shoulder.

3. The combination of claim 1, wherein the forward portion of the socket has an outer diameter which is substantially coterminous, radially, with the outer diameter of the sleeve.

4. The combination of claim 1, further including keying means between the sleeve and the rearward portion of the socket.

5. The combination of claim 4, wherein the keying means comprises a pair of substantially diametrically-opposed flats formed on the rearward portion of the socket, and the sleeve having a pair of substantially diametrically-opposed flat portions formed therein and cooperating with the respective flats on the rearward portion of the socket.

6. In combination with a wrench socket having a forward portion and further having a rearward portion, a sleeve carried by the rearward portion of the socket, the sleeve having an outer diameter which is substantially coterminous, radially, with the outer diameter of the forward portion of the socket, said sleeve further having a recess formed therein, keying means between the sleeve and the rearward portion of the socket, thereby precluding relative rotation between the socket and the sleeve, and indicia means disposed in the recess on the sleeve for identifying the socket.

7. The combination of claim 6, wherein the rearward portion of the socket has a reduced diameter with respect to the forward portion, thereby forming an annular shoulder between the forward and rearward portions of the socket, and wherein the sleeve is seated against the shoulder.

8. The combination of claim 7, wherein the sleeve is molded from an elastomeric material and has indicia thereon for convenient recognition and selection.

9. In combination with a socket for a ratchet wrench, wherein the socket has a rearward portion provided with a rearward end face, a molded elastomeric sleeve carried by the rearward portion of the socket and extending to at least the rearward end face thereof, and the sleeve having a recess formed therein, said sleeve further having size indicia disposed in the recess, thereby facilitating a convenient recognition and selection of the socket.

10. The combination of claim 9, wherein the size indicia comprises a pair of indicia, substantially diameterically opposed to one another and inverted relative to one another, such that the indicia will become easily recognized regardless of the vertical orientation of the socket.

11. The combination of claim 9, further including knurls formed on the sleeve, thereby facilitating a manual rotation of the socket, and thereby preventing the socket from rolling when placed sideways on a flat surface.

12. In combination with a socket for a ratchet wrench, the socket having respective forward and rearward portions, the rearward portion of the socket having a reduced outer diameter, thereby forming an annular shoulder between the forward and rearward portions of the socket, the forward portion of the socket having an outer diameter, the rearward portion of the socket having a rearward end face, a molded elastomeric sleeve having a recess formed therein, said sleeve being secured on the rearward portion of the socket and abutting against the annular shoulder, the sleeve extending axially substantially to the rearward end face of the rearward portion of the socket, the sleeve further extending radially substantially coterminous with the outer diameter of the forward portion of the socket, indicia means disposed in the recess on the sleeve for facilitating convenient recognition of the socket, and knurls formed on the sleeve, thereby facilitating a manual rotation of the socket, and thereby preventing the socket from rolling when placed sideways on a flat surface.

13. A sleeve adapted to be secured to the rearward portion of a wrench socket, said sleeve comprising: an annular sleeve portion adapted to be received on the rearward portion of the wrench socket, said sleeve portion having a recess formed therein and an indicia means disposed in the recess for facilitating a convenient recognition and selection of the socket.

14. The sleeve of claim 13, wherein the sleeve and socket have respective rearward end faces which are substantially aligned axially with one another.

15. The sleeve of claim 13, further including knurls on the sleeve for facilitating a manual rotation of the socket.

16. An elastomeric sleeve adapted to be secured to the rearward portion of a wrench socket, the sleeve comprising: a sleeve portion adapted to be received on the rearward portion of the wrench socket, said sleeve having a recess formed therein, said sleeve further having indicia means disposed in the recess for facilitating a convenient recognition and selection of the socket, the sleeve and socket having respective rearward end faces which are substantially aligned axially with one another, and knurls on the sleeve for facilitating a manual rotation of the socket.

17. In combination with a socket for a ratchet wrench, a molded elastomeric sleeve positioned on the socket, said sleeve having an outer diameter provided with knurls for facilitating manual rotation of the socket, adhesive means between the socket and the sleeve for securing the sleeve to the socket, thereby precluding relative rotation between the socket and the sleeve, said sleeve further having at least one recess formed therein, and size indicia in each respective recess.

18. The combination of claim 17, wherein the size indicia is molded in the recess.

19. The combination of claim 17, wherein the socket has respective forward and rearward portions, said rearward portion has a reduced outer diameter, whereby an annular shoulder is defined between the forward and rearward portion of the socket and, wherein the sleeve is positioned on the rearward portion of the socket abutting against the annular shoulder.

20. The combination of claim 17, wherein the recess is molded in the sleeve.

21. A sleeve adapted to be received on a socket for a ratchet wrench, said sleeve comprising;

an elastomeric annular sleeve portion being positioned on the socket, said sleeve portion having an outer diameter provided with knurls for facilitating manual rotation of the socket;

adhesive means between the socket and the sleeve for securing the sleeve to the socket, thereby precluding relative rotation between the socket and the sleeve;

said sleeve further having at least one recess formed therein; and size indicia disposed in each respective recess.

* * * * *